US007914265B2

(12) United States Patent
Coles et al.

(10) Patent No.: US 7,914,265 B2
(45) Date of Patent: Mar. 29, 2011

(54) EVACUATION OF A LOAD LOCK ENCLOSURE

(75) Inventors: Stuart Charles Coles, Peasemore (GB); Michael Andrew Galtry, Worthing (GB); David Alan Turrell, Burgess Hill (GB); Patrick Brian Clayton, Worthing (GB)

(73) Assignee: Edwards Limited, Crawley, West Sussex (GB)

( * ) Notice: Subject to any disclaimer, the term of this patent is extended or adjusted under 35 U.S.C. 154(b) by 791 days.

(21) Appl. No.: 11/660,339

(22) PCT Filed: Aug. 17, 2005

(86) PCT No.: PCT/GB2005/003221

§ 371 (c)(1),
(2), (4) Date: Aug. 20, 2007

(87) PCT Pub. No.: WO2006/018639

PCT Pub. Date: Feb. 23, 2006

(65) Prior Publication Data

US 2008/0089793 A1 Apr. 17, 2008

(30) Foreign Application Priority Data

Aug. 20, 2004 (GB) ..... 0418771.2

(51) Int. Cl.
*F04B 3/00* (2006.01)

(52) U.S. Cl. ..... 417/244; 417/423.4; 118/715

(58) Field of Classification Search ..... 417/244, 417/423.4; 118/715–733; 156/345.31, 345.32, 156/345.29

See application file for complete search history.

(56) References Cited

U.S. PATENT DOCUMENTS

| | | | | |
|---|---|---|---|---|
| 4,850,806 | A * | 7/1989 | Morgan et al. | 417/53 |
| 4,887,941 | A | 12/1989 | Crinquette et al. | |
| 5,039,280 | A * | 8/1991 | Saulgeot et al. | 417/205 |
| 5,165,864 | A | 11/1992 | Burger et al. | |
| 5,575,853 | A * | 11/1996 | Arami et al. | 118/708 |
| 5,595,477 | A | 1/1997 | Amlinger | |
| 6,056,510 | A | 5/2000 | Miura et al. | |
| 6,446,651 | B1 | 9/2002 | Abbel | |
| 2002/0131870 | A1 | 9/2002 | Puech | |

(Continued)

FOREIGN PATENT DOCUMENTS

DE 118 144 A1 2/1976

(Continued)

OTHER PUBLICATIONS

Reissmueller Lothar, Huebner Dietrich; Abstract of Patent No. DD118144 A1, "Gas Container Quick Evacuation Method—Uses Two Control Valves and Time Programme," Feb. 12, 1976.

(Continued)

*Primary Examiner* — Charles G Freay
*Assistant Examiner* — Todd D Jacobs

(57) ABSTRACT

A system for evacuating an enclosure is provided. The system includes a first vacuum pump having an inlet selectively connectable to an outlet from the enclosure. A second vacuum pump is also provided together with a conduit for connecting an exhaust of the first vacuum pump to an inlet of the second vacuum pump. An auxiliary chamber is provided, this chamber being selectively connectable to the conduit such that, in a first state, gas can be drawn from the auxiliary chamber by the second vacuum pump in isolation from the enclosure, and, in a second state, gas can be drawn from the enclosure to the auxiliary chamber through the first vacuum pump.

14 Claims, 10 Drawing Sheets

U.S. PATENT DOCUMENTS

| | | | | |
|---|---|---|---|---|
| 2003/0068233 | A1 | 4/2003 | Royce et al. | |
| 2004/0136835 | A1* | 7/2004 | Bez et al. | 417/254 |
| 2004/0146410 | A1* | 7/2004 | Conrad et al. | 417/245 |
| 2004/0191079 | A1* | 9/2004 | Ohmi et al. | 417/244 |
| 2005/0129509 | A1* | 6/2005 | Jostlein | 415/143 |
| 2006/0182638 | A1* | 8/2006 | Ohmi | 417/87 |

FOREIGN PATENT DOCUMENTS

| | | | |
|---|---|---|---|
| JP | 4-141936 | A | 5/1992 |

OTHER PUBLICATIONS

Yoshimura Nagamitsu, Hirano Haruo; Abstract of Patent No. JP 4141936 A, "Evacuation Device," May 15, 1992; Jeol Ltd.

Niimura Yoshihiro; Abstract of Patent Application JP 11230034, "Evacuating System and Its Operating Method," Ebara Corp; Aug. 24, 1999.

United Kingdom Search Report of Application No. GB 0418771.2; dated Nov. 26, 2004; Claims searched: 1-13; Date of search: Nov. 25, 2004.

United Kingdom Search Report of Application No. GB 0418771.2; Claims searched: 14-24; Date of search: Feb. 11, 2005.

PCT Notification of Transmittal of the International Search Report and the Written Opinion of the International Searching Authority, or the Declaration of International Application No. PCT/GB2005/003221; Date of mailing: Dec. 6, 2005.

PCT International Search Report of International Application No. PCT/GB2005/003221; Date of mailing of the International Search Report: Dec. 6, 2005.

PCT Written Opinion of the International Searching Authority of International Application No. PCT/GB2005/003221; Date of mailing: Dec. 6, 2005.

* cited by examiner

EVACUATION OF A LOAD LOCK ENCLOSURE

FIELD OF THE INVENTION

The present invention relates to a system for evacuating an enclosure, and in particular to the evacuation of load lock chambers.

BACKGROUND OF THE INVENTION

Vacuum processing is commonly used in the manufacture of semiconductor devices to deposit thin films on to substrates. Typically, a processing enclosure is evacuated to a very low pressure, which, depending on the type of process, may be as low as $10^{-6}$ mbar, and feed gases are introduced to the evacuated enclosure to cause the desired material to be deposited on one or more substrates located in the enclosure. Upon completion of the deposition, the substrate is removed from the enclosure and another substrate is inserted for repetition of the deposition process.

Significant vacuum pumping time is required to evacuate the processing enclosure to the required pressure. Therefore, in order to maintain the pressure in the enclosure at or around the required level when changing substrates, transfer enclosures and load lock enclosures are typically used. The capacity of the load lock enclosure can range from just a few litres to several thousand litres for some of the larger flat panel display tools.

The load lock enclosure typically has a first window, which can be selectively opened to allow substrates to be transferred between the load lock enclosure and the transfer enclosure, and a second window, which can be selectively opened to the atmosphere to allow substrates to be inserted into and removed from the load lock enclosure. In use, the processing enclosure is maintained at the desired vacuum by a processing enclosure vacuum pumping arrangement. With the first window closed, the second window is opened to the atmosphere to allow the substrate to be inserted into the load lock enclosure. The second window is then closed, and, using a load lock vacuum pumping arrangement, the load lock enclosure is evacuated until the load lock enclosure is at substantially the same pressure as the transfer enclosure, typically around 0.1 mbar. The first window is then opened to allow the substrate to be transferred to the transfer enclosure. The transfer enclosure is then evacuated to a pressure at substantially the same pressure as the processing enclosure, whereupon the substrate is transferred to the processing enclosure.

When vacuum processing has been completed, the processed substrate is transferred back to the load lock enclosure. With the first window closed to maintain the vacuum in the transfer enclosure, the pressure in the load lock enclosure is brought up to atmospheric pressure by allowing a non-reactive gas, such as air or nitrogen, to flow into the load lock enclosure. When the pressure in the load lock enclosure is at or near atmospheric pressure, the second window is opened to allow the processed substrate to be removed. Thus, for a load lock enclosure, a repeating cycle of evacuation from atmosphere to a medium vacuum (around 0.1 mbar) is required.

In order to increase throughput and consequently output of the finished product, it is desirable to reduce the pressure in the load lock enclosure as rapidly as possible. In some systems, such as that described in JP11-230034 and as represented in FIG. 1, this desire has lead to implementation of a pre-evacuated auxiliary chamber 4 acting in combination with a pumping arrangement 3 to evacuate a load lock enclosure 1. The auxiliary chamber 4, which may be isolated from the load lock pumping arrangement 3 by isolation valve 5, is used to initiate the pump down process and assist in achieving improved pump down cycle time. In the illustrated system, the pumping arrangement 3 comprises two booster pumps 6 upstream of four backing pumps 7.

In this system, with isolation valve 2 in a closed position and isolation valve 5 in an open position, the auxiliary chamber 4 is evacuated by the pumping arrangement 3 before evacuation of the load lock enclosure 1 is initiated. When evacuation of the load lock enclosure 1 is required, the isolation valves 2, 5 are both opened so that the load lock enclosure 1 is in fluid communication both with the pumping arrangement 3 and the evacuated auxiliary chamber 4. The pressures within the enclosure 1 and the chamber 4 rapidly equalise, causing a large "slug" of high pressure fluid to rush from the load lock enclosure 1 towards the evacuated auxiliary chamber 4. As the pumping arrangement 3 continues to draw fluid as the pressure equalises between the load lock enclosure 1 and the auxiliary chamber 4, an effect of this slug of high pressure fluid rushing into the auxiliary chamber 4 is a rapid increase in the pressure at the inlets of the booster pumps 6, which causes the rotation speed of the pumping mechanism of the booster pumps 6 to be significantly slowed. For example, the rotational speed of a single stage Roots booster pump will typically vary from a maximum value of approximately 100 Hz when at 0.1 mbar to a lower value of approximately 15 Hz when atmospheric conditions are approached. Consequently, the slug of high pressure fluid experienced by the booster pumps 6 would rapidly reduce the rotational speeds of the booster pumps 6 to approximately 15 Hz.

Once this pressure equalisation has taken place, the auxiliary chamber 4 is isolated from the pumping arrangement 3 by closing isolation valve 5, and further evacuation of the load lock enclosure 1 is carried out by the pumping arrangement 3 alone. As the rotational speed of the booster pumps 6 has been significantly reduced, there is a delay whilst the rotational speed is restored to an appropriate operating level. Indeed, it may take up to 10 seconds to return the booster pumps 6 to their optimum operating conditions of approximately 100 Hz. This delay adds to the overall time to evacuate the load lock enclosure 1.

It is an aim of at least one embodiment of the present invention to reduce the time required to evacuate an enclosure.

SUMMARY OF THE INVENTION

According to a first aspect of the present invention there is provided a system for evacuating an enclosure, the system comprising first pumping means having an inlet selectively connectable to an outlet from the enclosure, second pumping means, conduit means for connecting the exhaust of the first pumping means to the inlet of the second pumping means, and at least one auxiliary chamber selectively connectable to the conduit means such that, in a first state, gas can be drawn from said at least one auxiliary chamber by the second pumping means in isolation from the enclosure, and, in a second state, gas can be drawn from the enclosure to said at least one auxiliary chamber through the first pumping means.

In a second aspect, the present invention provides a method of evacuating an enclosure, the method comprising the steps of providing an evacuation system comprising first pumping means having an inlet selectively connectable to an outlet from the enclosure, second pumping means, conduit means for connecting the exhaust of the first pumping means to the inlet of the second pumping means, and at least one auxiliary chamber selectively connectable to the conduit means; isolating the first pumping means from the enclosure; drawing gas from said at least one auxiliary chamber using the second pumping means; and connecting the first pumping means to the enclosure to enable gas to be drawn from the enclosure into said at least one auxiliary chamber through the first pumping means.

In a third aspect, the present invention provides a system for evacuating an enclosure, the system comprising vacuum pumping means, conduit means selectively connectable to an outlet from the enclosure for conveying gas from the enclosure to the vacuum pumping means, and a plurality of auxiliary chambers each being selectively connectable to the conduit means in isolation from the or each other of the auxiliary chambers, such that, in a first state, gas can be drawn from the auxiliary chambers by the pumping means in isolation from the enclosure, and, in a second state, gas can be drawn from the enclosure to each of the auxiliary chambers in turn.

In a fourth aspect, the present invention provides a method of evacuating an enclosure, the method comprising the steps of providing an evacuation system comprising vacuum pumping means, conduit means selectively connectable to an outlet from the enclosure for conveying gas from the enclosure to the vacuum pumping means, and a plurality of auxiliary chambers each being selectively connectable to the conduit means in isolation from the or each other of the auxiliary chambers; isolating the pumping means from the enclosure; drawing gas from the auxiliary chambers using the pumping means; and connecting each of the auxiliary chambers to the enclosure in turn to enable gas to be drawn from the enclosure sequentially into the auxiliary chambers.

Features described above in relation to the first and second aspects of the invention are equally applicable to the third and fourth aspects of the invention and vice versa.

BRIEF DESCRIPTION OF THE DRAWINGS

The invention is described below in greater detail, by way of example only, with reference to the accompanying drawings, in which.

DETAILED DESCRIPTION OF THE INVENTION

According to a first aspect of the present invention there is provided a system for evacuating an enclosure, the system comprising first pumping means having an inlet selectively connectable to an outlet from the enclosure, second pumping means, conduit means for connecting the exhaust of the first pumping means to the inlet of the second pumping means, and at least one auxiliary chamber selectively connectable to the conduit means such that, in a first state, gas can be drawn from said at least one auxiliary chamber by the second pumping means in isolation from the enclosure, and, in a second state, gas can be drawn from the enclosure to said at least one auxiliary chamber through the first pumping means.

By locating the auxiliary chamber downstream of the first pumping means, in the second state the pumping mechanism of the first pumping means experiences a difference in pressure between that of the enclosure, as experienced at the inlet of the first pumping means, and that of the auxiliary chamber, as experienced at the outlet of the first pumping means. This pressure difference draws gas through the first pumping means towards the auxiliary chamber, and causes rotation of the pumping mechanism of the first pumping means. Consequently, once pressure equalisation between the enclosure and the auxiliary chamber has occurred, the pumping mechanism is rotating at a faster speed in comparison to the pumping mechanism in the booster pumps 6 of FIG. 1. As a result, the evacuation time of the enclosure is reduced.

Figure 1:
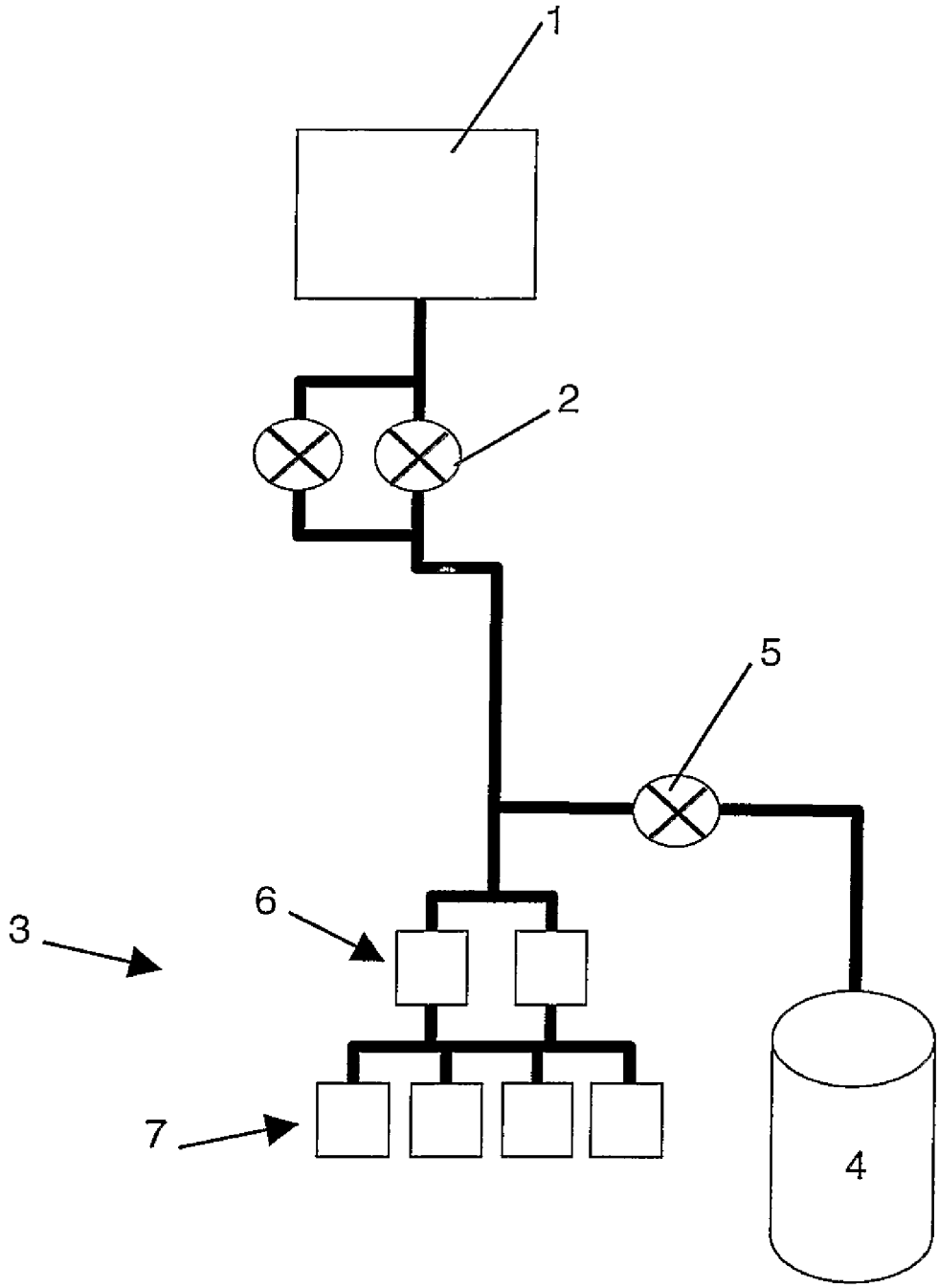
FIG. 1 illustrates a known system for evacuating an enclosure.

Furthermore, the rotation of the pumping mechanism of the first pumping means as gas is drawn therethrough increases the amount of gas that is driven into the auxiliary chamber than in the FIG. 1 arrangement. Consequently, the enclosure achieves a lower pressure when the pressure equalises between the enclosure and the auxiliary chamber, further reducing the evacuation time of the enclosure.

Where the first pumping means is provided by an arrangement of one or more booster pumps, it is desirable to move the arrangement close to the enclosure so that it can serve as a "proximity booster" arrangement. In this way, flow paths between the enclosure and the evacuation system are reduced, thereby improving the conductance of the evacuation system.

In a second aspect, the present invention provides a method of evacuating an enclosure, the method comprising the steps of providing an evacuation system comprising first pumping means having an inlet selectively connectable to an outlet from the enclosure, second pumping means, conduit means for connecting the exhaust of the first pumping means to the inlet of the second pumping means, and at least one auxiliary chamber selectively connectable to the conduit means; isolating the first pumping means from the enclosure; drawing gas from said at least one auxiliary chamber using the second pumping means; and connecting the first pumping means to the enclosure to enable gas to be drawn from the enclosure into said at least one auxiliary chamber through the first pumping means.

The evacuation system may comprise first valve means for selectively connecting the inlet of the first pumping means to the enclosure and second valve means for selectively connecting the at least one auxiliary chamber to the conduit means. The first valve means may be closed to isolate the first pumping means from the enclosure and the second valve means may be opened to enable gas to be drawn from the auxiliary chamber by the second pumping means. The first valve means may be subsequently opened to enable gas to be drawn from the enclosure through the first pumping means.

The first pumping means may comprise at least one vacuum pump, preferably a plurality of vacuum pumps connected in parallel. The, or each, vacuum pump of the first pumping means may comprise a booster pump.

The second pumping means may comprise at least one vacuum pump, preferably a plurality of vacuum pumps connected in parallel to the conduit means. The, or each, vacuum pump of the second pumping means may comprise a backing pump.

The evacuation system may comprise a second conduit means for selectively connecting the inlet of the first pumping means to the at least one auxiliary chamber. Subsequent to isolating the enclosure from the first pumping means, the at least one auxiliary chamber may be connected to the inlet of the first pumping means via the second conduit means to enable gas to be drawn from the auxiliary chamber by the first pumping means.

The evacuation system may comprise a third conduit means for selectively connecting an outlet of the second pumping means to the at least one auxiliary chamber. Subsequent to drawing gas from the enclosure into the at least one auxiliary chamber, the second valve means may be closed to isolate the auxiliary chamber from the conduit means and the at least one auxiliary chamber may be subsequently connected to the outlet of the second pumping means via the third conduit means to thereby reduce a pressure at the outlet of the second pumping means.

Whilst it is possible to increase the volume of the auxiliary chamber used to partially evacuate the enclosure, it has been found that a reduced pressure can be achieved from the same auxiliary chamber volume by subdividing that chamber into a plurality of separate auxiliary chambers each connected to the conduit means by a respective valve. Hence the overall duration of the evacuation process may be further reduced.

From the ideal gas law it will be apparent that upon providing fluid communication between any two volumes of different initial pressures, the ultimate equilibrium pressure achieved throughout will be dependent on the volume and the initial pressures of the enclosures in question. Where the two volumes are the same size, the ultimate equilibrium pressure will fall mid-way between the two initial pressures. Where the lower pressure enclosure, here the auxiliary chamber, is of greater volume, the resulting equilibrated pressure will be proportionally lower. By providing a number of smaller auxiliary chambers which are linked to the enclosure in sequence rather than a single large one (albeit of the same volume) a lower final equilibrium pressure will be achieved in the enclosure.

For example, consider a situation where the volume ratio of the enclosure to a single auxiliary chamber is 1:3, and the enclosure is initially at a pressure of around 800 mbar and the auxiliary chamber is initially at a pressure of around 10 mbar. When the two volumes are connected together, the pressure will equalise at around 200 mbar.

Now consider a situation where the single auxiliary chamber is replaced by three separate auxiliary chambers, and where the volume ratio of the enclosure to each auxiliary chamber is 1:1. Again, the enclosure is initially at a pressure of around 800 mbar and each auxiliary chamber is initially at a pressure of around 10 mbar. When the enclosure is connected to the first auxiliary chamber only, the pressure will equilibrate to around 400 mbar. When the enclosure is subsequently connected to the second auxiliary chamber, the pressure will equilibrate to around 200 mbar. When the enclosure is connected to the third auxiliary chamber only, the pressure will equilibrate to around 100 mbar, that is, approximately half of the pressure when a single auxiliary chamber was used.

A further benefit may be achieved in that the greater number of smaller auxiliary chambers may be more easily accommodated within the space available. Another benefit is provided in that the use of large auxiliary chambers, as typically used in conventional systems, requires the use of large valves. Large valves that are capable of reliably performing millions of cycles are very expensive. It is considerably cheaper to obtain smaller dimensioned valves of the required level of reliability. It is thus possible to utilise smaller valves in combination with a greater number of lower volume auxiliary chambers.

Thus the at least one auxiliary chamber may comprise a single auxiliary chamber selectively connectable to the conduit means or it may comprise a plurality of auxiliary chambers, each being selectively connectable to the conduit means. Where a plurality of auxiliary chambers are provided the evacuation system may comprise third valve means for selectively connecting a selected one of the auxiliary chambers to the conduit means in isolation from the or each other one of the auxiliary chambers. Each of the auxiliary chambers may be connected to the conduit means in turn to enable gas to be drawn from the enclosure sequentially into the auxiliary chambers through the first pumping means.

In a third aspect, the present invention provides a system for evacuating an enclosure, the system comprising vacuum pumping means, conduit means selectively connectable to an outlet from the enclosure for conveyinq gas from the enclosure to the vacuum pumping means, and a plurality of auxiliary chambers each being selectively connectable to the conduit means in isolation from the or each other of the auxiliary chambers, such that, in a first state, gas can be drawn from the auxiliary chambers by the pumping means in isolation from the enclosure, and, in a second state, gas can be drawn from the enclosure to each of the auxiliary chambers in turn.

In a fourth aspect, the present invention provides a method of evacuating an enclosure, the method comprising the steps of providing an evacuation system comprising vacuum pumping means, conduit means selectively connectable to an outlet from the enclosure for conveying gas from the enclosure to the vacuum pumping means, and a plurality of auxiliary chambers each being selectively connectable to the conduit means in isolation from the or each other of the auxiliary chambers; isolating the pumping means from the enclosure; drawing gas from the auxiliary chambers using the pumping means; and connecting each of the auxiliary chambers to the enclosure in turn to enable gas to be drawn from the enclosure sequentially into the auxiliary chambers.

Features described above in relation to the first and second aspects of the invention are equally applicable to the third and fourth aspects of the invention and vice versa.

The evacuation system may comprise first valve means for selectively connecting the conduit means to the enclosure and second valve means for selectively connecting the auxiliary chambers to the conduit means. The second valve means may comprise a plurality of valves for each selectively connecting a respective auxiliary chamber to the conduit means. The first valve means may be closed to isolate the pumping means from the enclosure and at least one valve of the second valve means may be opened to enable gas to be drawn from the respective auxiliary chamber by the pumping means. The first valve means may be subsequently opened and the valves of the second valve means may be initially closed and subsequently sequentially opened to enable gas to be drawn from the enclosure into each respective auxiliary chamber sequentially.

The pumping means may comprise first pumping means having an inlet connected to the conduit means, and second pumping means having an inlet connected to the outlet from the first pumping means. The first pumping means may comprise at least one vacuum pump, preferably a plurality of vacuum pumps connected in parallel. The, or each, vacuum pump of the first pumping means may comprise a booster pump.

The second pumping means may comprise at least one vacuum pump, preferably it may comprise a plurality of vacuum pumps connected in parallel. The, or each, vacuum pump of the second pumping means may comprise a backing pump.

The evacuation system may comprise a second conduit means for selectively connecting the inlet of the first pumping means to the at least one auxiliary chamber and/or a third conduit means for selectively connecting the outlet of the second pumping means to the at least one auxiliary chamber.

Figure 2:
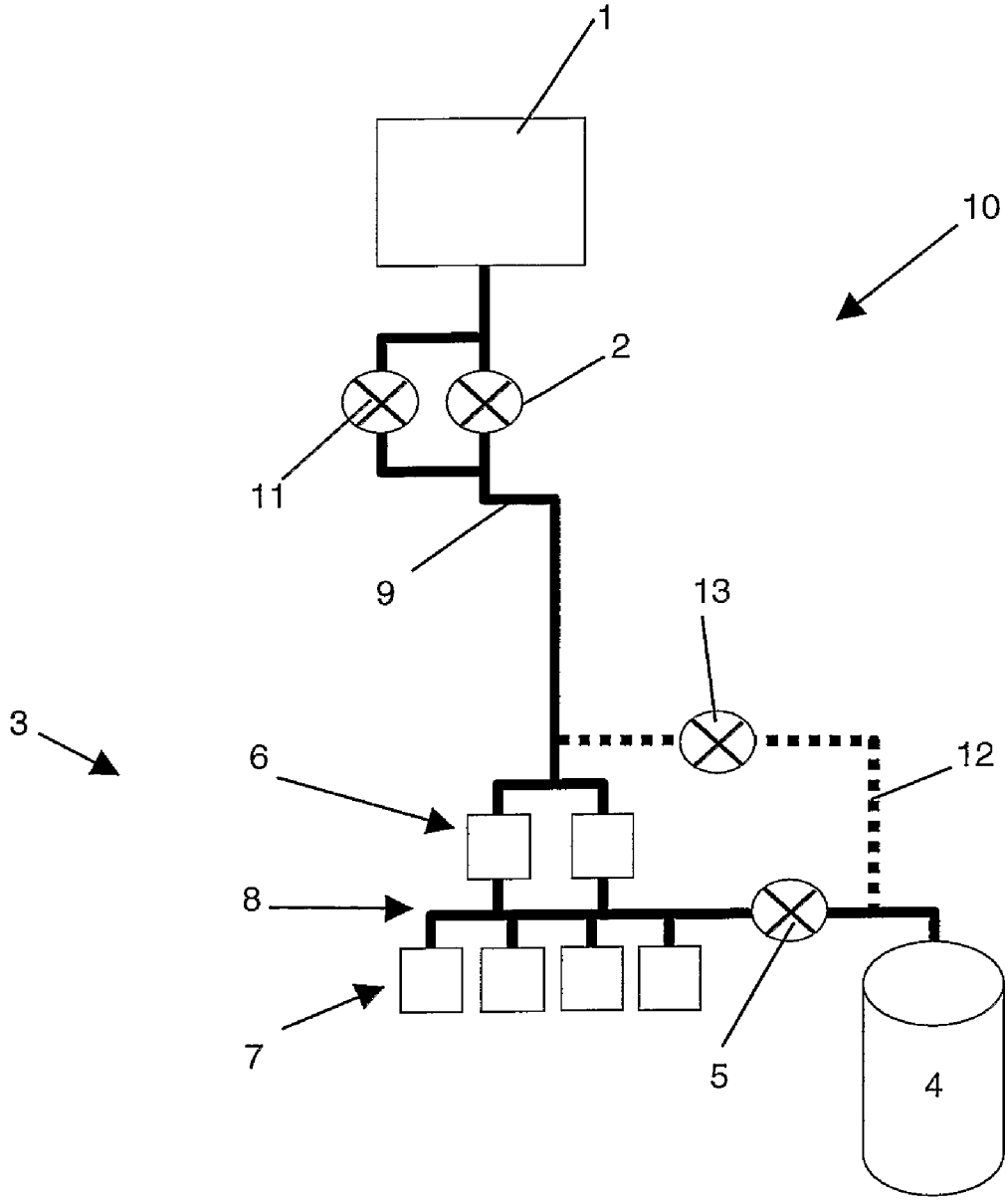
FIG. 2 illustrates a first embodiment of a system for evacuating an enclosure.

A first embodiment of a system 10 for evacuating an enclosure 1 is illustrated in FIG. 2. The evacuation system is particularly suitable for evacuating a load lock enclosure, although it may also be used for evacuating other enclosures that require rapid evacuation. The evacuation system 10 comprises a pumping arrangement 3, which, in turn, comprises first pumping means 6 and second pumping means 7 downstream from the first pumping means 6. This double-tiered type of pumping arrangement 3 is conventionally used in evacuation systems to reach a lower pressure than might be achieved by a single type of vacuum pump.

In this embodiment, the first pumping means is provided by two booster pumps 6, and the second pumping means is provided by four backing pumps 7. Multiple numbers of pumps 6, 7 can be used to enable evacuation of a large capacity load lock enclosure 1 as may be found in a flat panel display tool. However, any suitable number of booster pumps 6 and backing pumps 7 may be provided.

The inlets of the booster pumps 6 are connected in parallel to receive gas from the enclosure 10. The outlets from the booster pumps 6 are connected to a conduit system 8, which conveys gas exhaust from the booster pumps 6 to the backing pumps 7. The inlets of the backing pumps 7 are connected in parallel to the conduit system 8. The conduit system 8 thus allows fluid communication between the two sets of pumps 6,7.

A first isolation valve 2 is provided within a conduit 9 extending between the outlet of the enclosure 1 and the inlets of the booster pumps 6. This isolation valve 2 enables the conduit 9 to be selectively opened and closed. As described in more detail below, in some circumstances such as a "soft start" it may be desirable to restrict rather than totally prevent gas from flowing through the conduit 9. In order to achieve such a restricted flow, an additional valve 11 having a variable conductance may be provided in parallel with the isolation valve 2, as shown in FIG. 2.

An auxiliary chamber 4 is connected to the conduit system 8, whereby the auxiliary chamber 4 is provided downstream of the booster pumps 6 and upstream of the backing pumps 7. The passage between the conduit system 8 and the auxiliary chamber 4 is selectively opened and closed by a second isolation valve 5 located within the conduit system 8. A recharge conduit 12 may be optionally implemented (as shown by a dashed line in FIG. 2) between the auxiliary chamber 4 and the conduit 9. A recharge isolation valve 13 positioned in the recharge conduit 12 permits the auxiliary chamber 4 to be placed in fluid communication with inlets of the booster pumps 6 when the recharge isolation valve 13 is in an open position and isolated from the inlets of the booster pumps 6 when the recharge isolation valve 13 is in a closed position.

Figure 3:
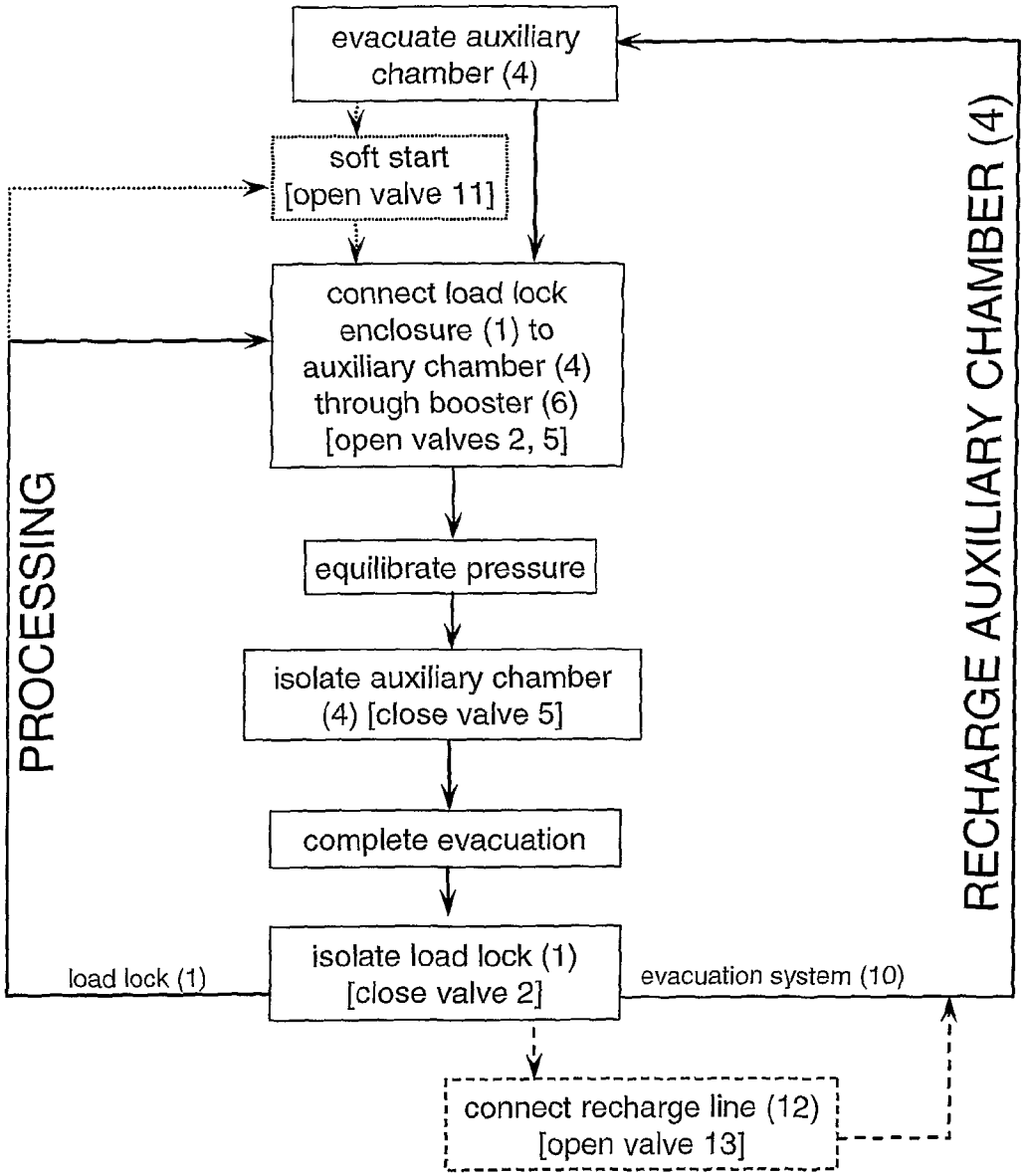
FIG. 3 is a flow chart representing an evacuation method to be carried out using the system of FIG. 2.

Operation of the evacuation system 10 is now described with reference to FIGS. 2 and 3. The enclosure 1 is initially isolated from the evacuation system 10 by closing the first isolation valve 2 and the additional valve 11. With the pumping arrangement switched on, the second isolation valve 5 is opened to allow gas to be drawn from the auxiliary chamber 4 by the backing pumps 7. This is referred to as "recharging" of the auxiliary chamber 4. This can reduce the pressure within the auxiliary chamber down to, for example, 100 mbar. Where the optional recharge conduit 12 is provided, as represented by dashed lines in FIG. 3, the second isolation valve 5 remains closed whilst the recharge isolation valve 13 is opened. Gas will then be drawn from the auxiliary chamber 4 by both the booster pumps 6 and the backing pumps 7, thus enabling the auxiliary chamber 4 to be evacuated to a lower pressure, for example, 30 mbar, thus further improving the subsequent performance of the evacuation system 10. Once the pressure in the auxiliary chamber 4 has been reduced to the desired level, the second isolation valve 5 (or the recharge isolation valve 13) is closed.

Benefits are associated with both recharge configurations. During recharging of the auxiliary chamber 4 by just the backing pumps 7 (that is, with the second isolation valve 5 open and recharge valve 13 closed) the booster pumps 6 may be isolated from the backing pumps 7 using isolation valves (not illustrated) to enable booster pumps 6 to remain at "ultimate" (that is, in a low power mode) whilst the backing pumps 7 evacuate the chamber 4. This leads to power savings, but the pressure reached in the auxiliary chamber 4 is typically not as low as it is when both the booster pumps 6 and the backing pumps 7 are used to evacuate the auxiliary chamber 4.

Alternatively, where the recharge conduit 12 is provided, these power savings will not be attained but the auxiliary chamber 4 may be reduced to a lower pressure, providing for a further reduction in the duration of the evacuation of the enclosure 1.

Once the auxiliary chamber 4 has been recharged, evacuation of the enclosure 1 commences. In some circumstances, it may be necessary to provide a "soft start" whereby the initial evacuation of the enclosure 1 is performed at a reduced rate. This may be necessary, for example, to prevent condensation occurring within the enclosure 1 due to the Wilson Cloud Effect. In these circumstances the first isolation valve 2 remains initially closed, and, as indicated by the dotted arrows and box in FIG. 3, the additional valve 11 is opened sufficiently to enable a relatively low gas flow to be drawn from the enclosure 1 by the pumping arrangement 3.

Following this initial evacuation, the pressure in the enclosure 1 is typically around 700 mbar. The first isolation valve 2, second isolation valve 5, and the additional valve 11 are then fully opened. Opening of the isolation valves 2, 5 fully opens a gas passageway extending from the enclosure 1, through the conduit 9, booster pumps 6, and part of the conduit system 8 to the auxiliary chamber 4. Since this passageway passes through the booster pumps 6, a pressure difference is experienced across the pumping mechanisms of the booster pumps 6. These pumping mechanisms may be, for example, Roots-type pumping mechanisms. This pressure difference causes the pumping mechanisms to be rotated.

As the pressure of the enclosure 1 and the auxiliary chamber 4 equilibrates, the pressure difference across the pumping mechanisms of the booster pumps 6 reduces to zero. However, due to an additional pumping capacity associated with the rotation of the pumping mechanisms, the pressure in the auxiliary chamber 4 may be raised above the equilibrium value expected under normal steady state conditions. At this point, the second isolation valve 5 is closed to isolate the auxiliary chamber 4 from the enclosure 1 and the pumping arrangement 3. Operation of the pumps 6, 7 is continued to further evacuate the enclosure to the desired pressure level, typically 0.1 mbar.

Figure 4:
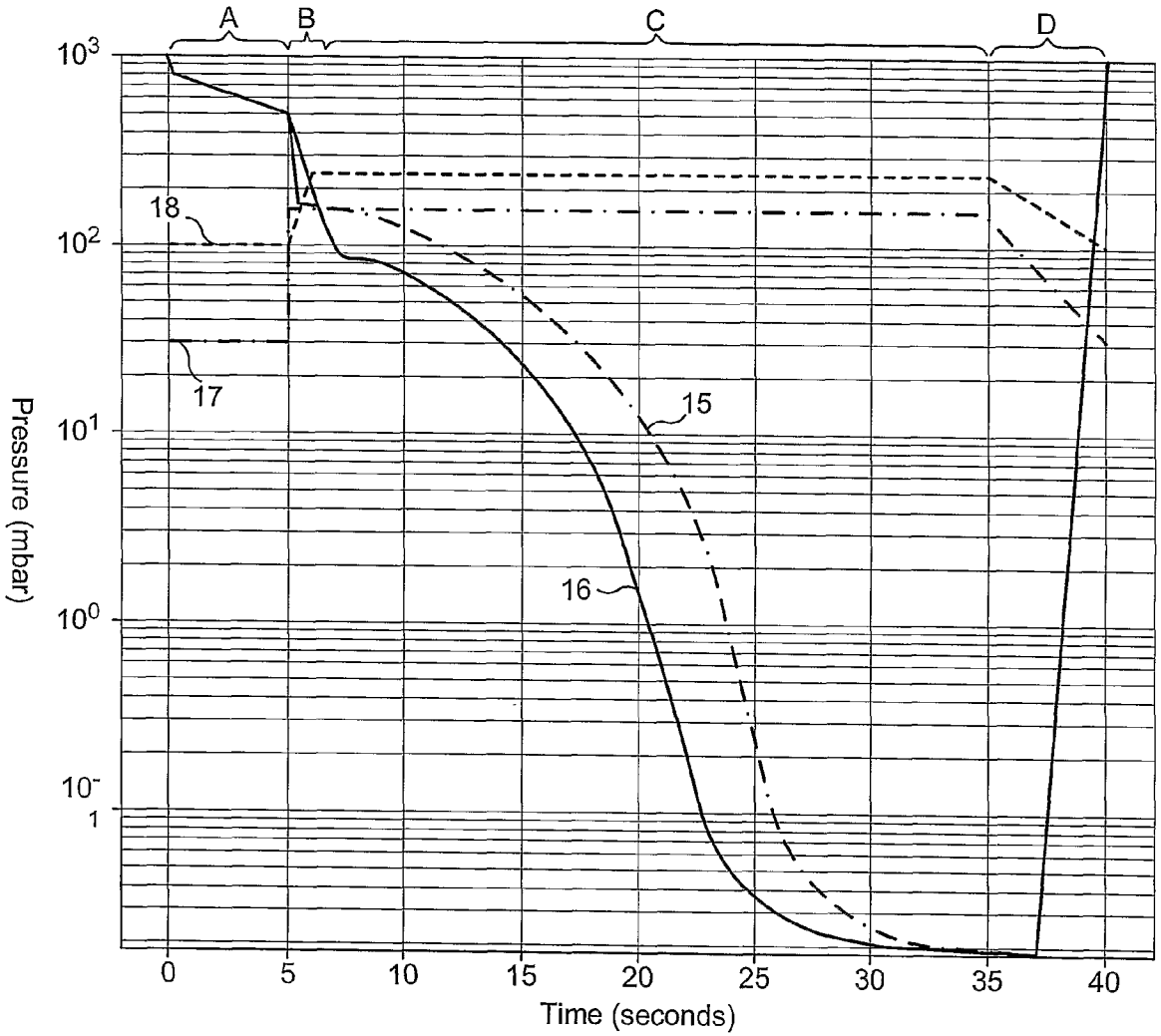
FIG. 4 is a graphical representation of the variations with time of the pressures in the enclosure and the auxiliary chamber for the systems illustrated in FIGS. 1 and 2.

FIG. 4 shows a graphical representation of the variation with time of the pressure within the enclosure 1 and the auxiliary chamber 4 of the evacuation system of FIG. 2 in comparison to the corresponding pressure variations with time for the prior system of FIG. 1. FIG. 4 illustrates four different pressure traces. Traces 15 and 17 indicate the variations of the pressure within the enclosure 1 and auxiliary chamber 4 respectively of the system of FIG. 1, and traces 16 and 18 indicate the variations of the pressure within the enclosure 1 and auxiliary chamber 4 respectively of the system of FIG. 2. There are four distinct phases in the pressure variations, labelled A to D, which are described in more detail below Phase A—"Soft Start"

As discussed above, during this phase the enclosure 1 reduces in pressure at a relatively low rate, but the auxiliary chamber 4 is isolated from the system such that its pressure remains static.

Phase B—"Equilibration"

During this phase, the enclosure 1 and the auxiliary chamber 4 are connected together by fully opening valves 2 and 5. Gas is drawn into the auxiliary chamber 4 until such a time as the pressure difference between the enclosure 1 and the auxiliary chamber 4 is eliminated. In the system of FIG. 2, the pumping mechanisms of the booster pumps 6 are forced to rotate by the flow of fluid therethrough, and this provides an additional pumping capacity over the conventional system of FIG. 1, such that the "equilibrated" pressure of the auxiliary chamber 4 in the system of FIG. 2 is somewhat higher than that of the conventional system of FIG. 1.

Phase C—Full Evacuation of the Enclosure

The auxiliary chamber 4 is now isolated once again from the enclosure 1 and thus remains at a constant pressure. In the system of FIG. 2, since the pumping mechanisms of the booster pumps 6 were forced to rotate during the equilibration phase B, these mechanisms do not experience the retardation associated with the conventional configuration of FIG. 1. Consequently, additional time is not required to accelerate the booster mechanisms back to an operational speed. Hence, as indicated by traces 15 and 16, the reduction in pressure of the enclosure 1 using the system of FIG. 2 is achieved several seconds sooner than in the equivalent conventional evacuation system.

Phase D—Auxiliary Chamber Recharge

Once the enclosure 1 has reached the required pressure, use of the enclosure 1 can take place. For example, where the enclosure is a load lock enclosure, a product located within the enclosure may be transferred into a transfer enclosure to continue processing. When required, the enclosure is returned to atmospheric pressure in a controlled manner, as shown by traces 15 and 16. The pumping arrangement 3 is therefore no longer required in association with the enclosure during this phase, and so is used to recharge the auxiliary chamber 4. In this example of the system of FIG. 2, there is no recharge line 12 and so the auxiliary chamber 4 is evacuated only by the backing pumps 7 to a pressure of approximately 100 mbar (as shown by trace 18), whereas in the conventional system, the auxiliary chamber 4 is connected upstream of the pumping arrangement 3 and is therefore evacuated by both the booster pumps 6 and the backing pumps 7 to a lower pressure of approximately 30 mbar.

The cycle may then restart and return to phase A.

Figure 5:
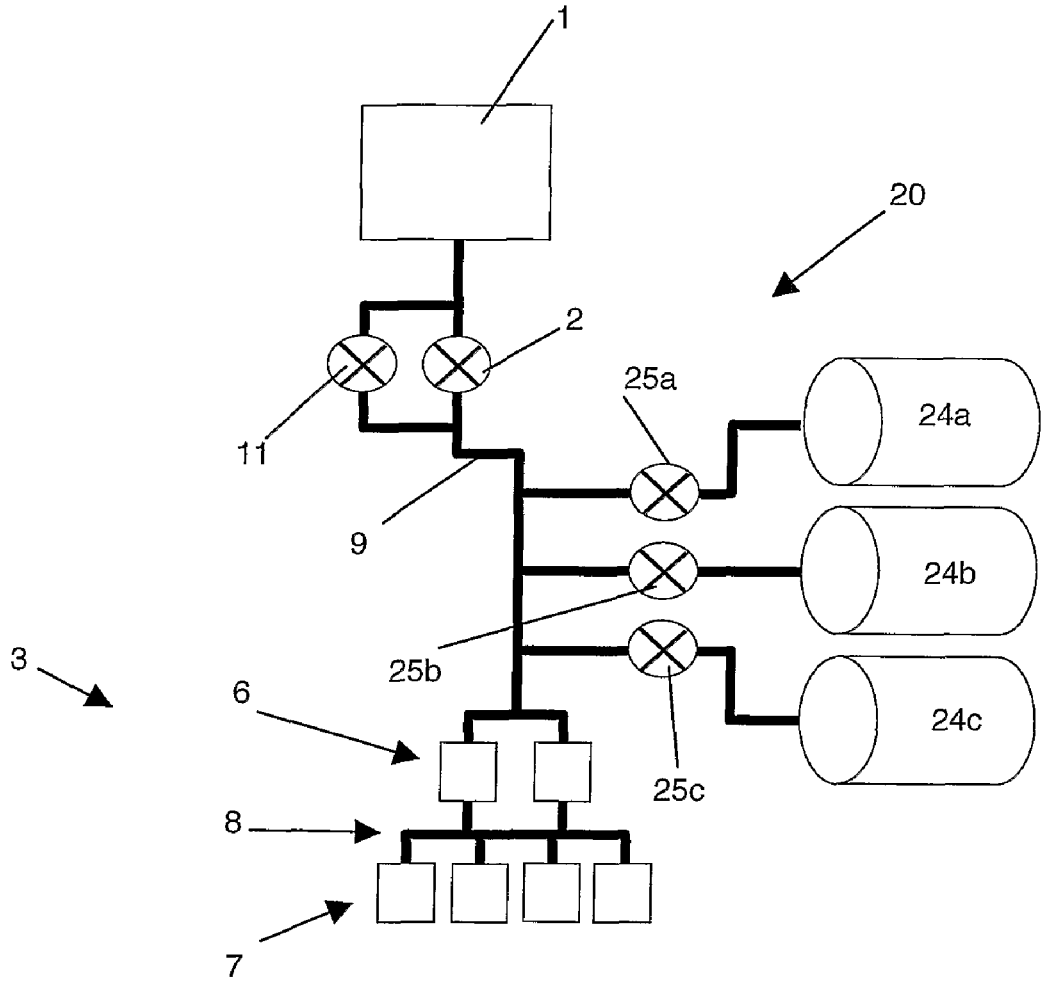
FIG. 5 illustrates a second embodiment of a system for evacuating an enclosure.

A second embodiment of an evacuation system 20 for evacuating an enclosure 1 is illustrated in FIG. 5. The system 20 is similar to the system 10 of the first embodiment, insofar as the system 20 includes a similar arrangement of a first isolation valve 2, additional valve 11, conduit 9, first pumping means 6, conduit system 8 and second pumping means 7 as the system 10 of the first embodiment, and so these elements of the system 20 will not be described again in detail here.

The system 20 of the second embodiment varies from the system 10 of the first embodiment in that the auxiliary chamber 4, second isolation valve 5, and the optional recharge conduit 12 and recharge valve 13 have been replaced by a plurality of auxiliary chambers 24*a*, 24*b*, 24*c* each selectively connected to the conduit 9 upstream of the booster pumps 6 by a respective second isolation valve 25*a*, 25*b*, 25*c*. In this embodiment, the auxiliary chambers 24*a*, 24*b*, 24*c* each have the same volume and, for the comparison purposes only, the combined volume of the three auxiliary chambers 24*a*, 24*b*, 24*c* is the same as that of the auxiliary chamber 4 of the conventional system of FIG. 1. Whilst three auxiliary chambers are provided in this embodiment, any suitable number of auxiliary chambers may be provided.

Figure 6:
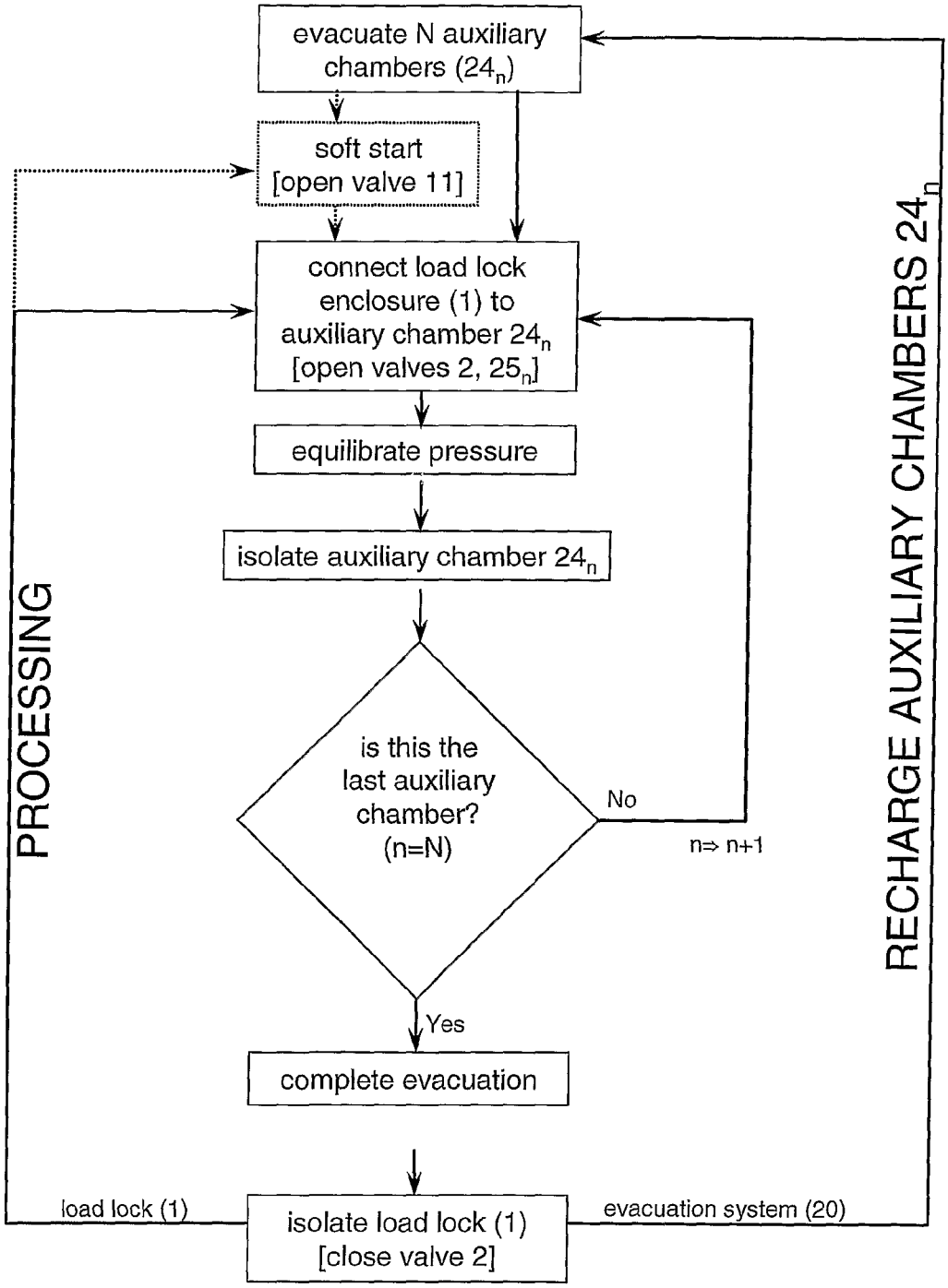
FIG. 6 is a flow chart representing an evacuation method to be carried out using the system of FIG. 5.

Operation of the evacuation system 20 is now described with reference to FIG. 6. The enclosure 1 is initially isolated from the evacuation system 20 by closing the first isolation valve 2 and the additional valve 11. With the pumping arrangement 3 switched on, each of the second isolation valves 25*a*, 25*b*, 25*c* is opened to allow gas to be drawn from the auxiliary chambers by the pumping arrangement 3. Once the auxiliary chambers have been evacuated to a pressure around, for example, 10 to 20 mbar, the second isolation valves 25*a*, 25*b*, 25*c* are closed. The evacuation system 20 is then in a "ready" state to commence evacuation of the enclosure 1.

As mentioned above with reference to the first embodiment, in some circumstances it may be necessary to provide a "soft start" whereby the initial evacuation of the enclosure 1 is performed at a reduced rate. This may be necessary, for example, to prevent condensation occurring within the enclosure 1 due to the Wilson Cloud Effect. In these circumstances the first isolation valve 2 remains initially closed, and, as indicated by the dotted arrows and box in FIG. 6, the additional valve 11 is opened sufficiently to enable a relatively low gas flow to be drawn from the enclosure 1 by the pumping arrangement 3.

Following this initial evacuation, the pressure in the enclosure 1 is typically around 700 mbar. The first isolation valve 2 and the additional valve 11 are then fully opened, and a first one 25*a* of the second isolation valves is opened to provide a flow path between the load lock enclosure 1 and the first auxiliary chamber 24*a*. Pressure equilibration takes place between the load lock enclosure 1 and auxiliary chamber 24*a*. Following equilibration, isolation valve 25*a* is closed to isolate auxiliary chamber 24*a* at the equilibrated pressure value. A second one 25*b* of the second isolation valves is then opened so that the partially evacuated enclosure 1 is exposed to the evacuated auxiliary chamber 24*b*. A second pressure equilibration phase then takes place between the enclosure 1 and the second auxiliary chamber 24*b*. Once this equilibration is complete, isolation valve 25*b* is closed. Finally, the third 25*c* of the second isolation valves is opened so that the enclosure 1 is exposed to the evacuated auxiliary chamber 24*c*. Where further evacuation chambers are provided, this sequence is continued until each of the auxiliary chambers has been sequentially placed in fluid communication with the enclosure 1 to further reduce the pressure therein.

Once all of the equilibration phases have been completed, evacuation of the enclosure is completed by the pumping arrangement 3 until the required level of vacuum is achieved.

The first isolation valve 2 is then closed, each of the auxiliary isolation valves 25*a*, 25*b*, 25*c* are opened and the auxiliary chambers 24*a*, 24*b*, 24*c* are recharged to return the evacuation system 20 to its "ready" state.

Figure 7:
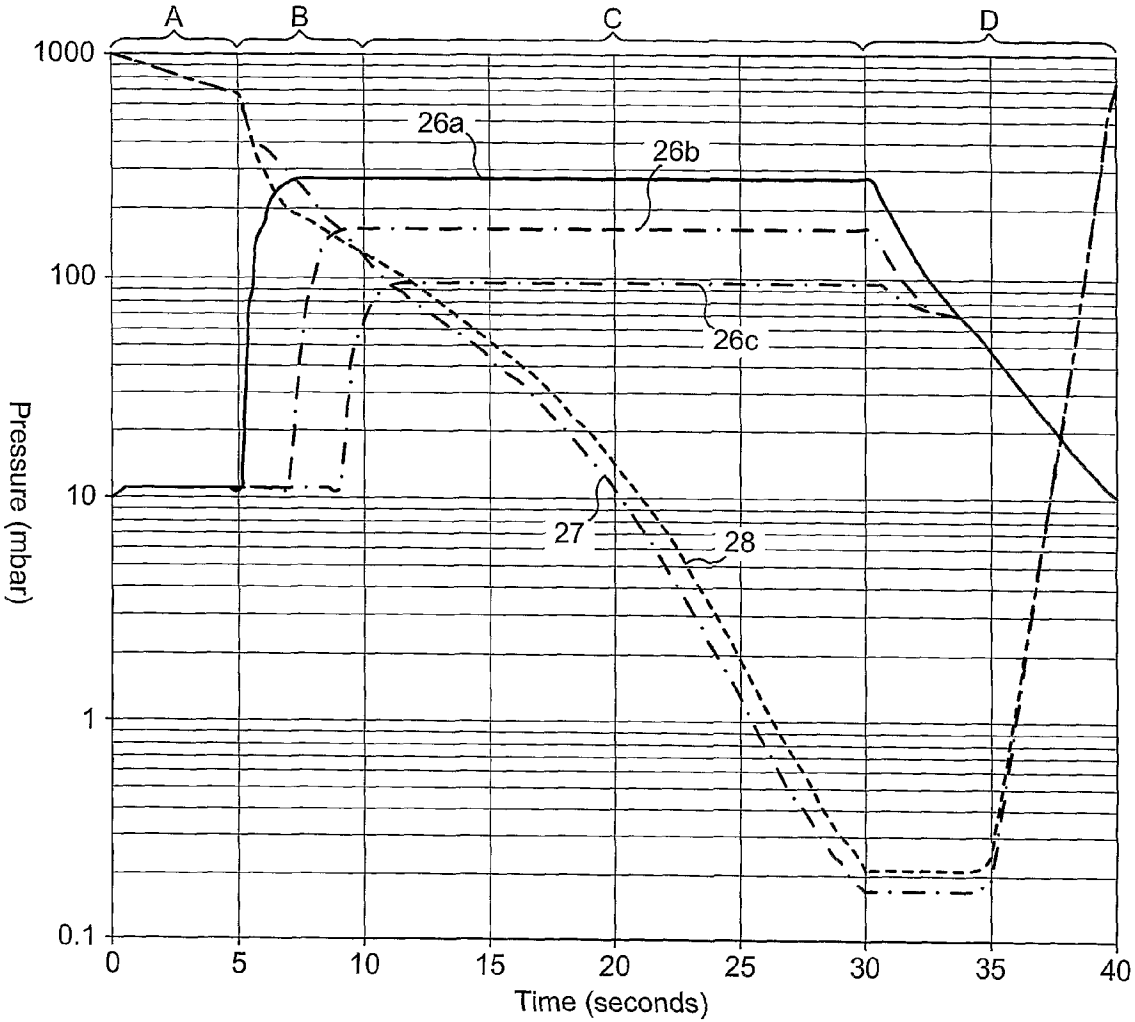
FIG. 7 is a graphical representation of the variations with time of the pressures in the enclosure and the auxiliary chamber for the systems illustrated in FIGS. 1 and 5.

FIG. 7 shows a graphical representation of the variation with time of the pressure within the enclosure 1 and the auxiliary chambers 24 of the evacuation system of FIG. 5. As in FIG. 4 there are 4 distinct phases, A to D. With this system, phases A, C and D are identical to those described above with reference to FIG. 4. However, phase B is now subdivided into a number of stages corresponding to the number of auxiliary chambers 24. In this example there are three such stages corresponding to the three equilibration steps. Three pressure traces 26*a*, 26*b*, 26*c* are illustrated, each corresponding to the pressure in one of the auxiliary chambers 24*a*, 24*b*, 24*c*. The three equilibration steps occur sequentially. After the "soft start" of phase A, the enclosure is brought into fluid communication with the first chamber 24*a* and the pressure between the two equalises. Isolation valve 25*a* is then closed and the pressure inside auxiliary chamber 24*a* remains static thereafter. This process is repeated with each of the other two auxiliary chambers 24*b* and 24*c*. During the pump down phase C the three auxiliary chambers maintain their respective equilibrated pressures (illustrated by horizontal sections on the pressure traces). In phase D the isolation valves 25*a*, 25*b*, 25*c* are all opened and the pressures between the three auxiliary chambers equalise and are subsequently re-evacuated by pumping arrangement 3 to a pressure of approximately 10 mbar.

Two enclosure pressure traces are plotted, trace 28 being for a conventional system similar to the system of FIG. 1 and trace 27 corresponding to the system of FIG. 5. In each case the pre-evacuated volume is the same, that is, the volume of the auxiliary chamber 4 is the same as the combined volumes of auxiliary chambers 24*a*, 24*b* and 24*c*. It can be seen from these enclosure pressure traces that whilst trace 28 indicates an initial surge when using the conventional system of FIG. 1, trace 27 indicates that the system of FIG. 5 ultimately reaches a lower pressure quicker than the conventional system. Indeed, in this example, trace 27 leads trace 28 by approximately 2 seconds. This reduction of 2 seconds is significant in a process cycle time of approximately 30 seconds and particularly where the evacuation process is repeated a large number of times.

Figure 8:
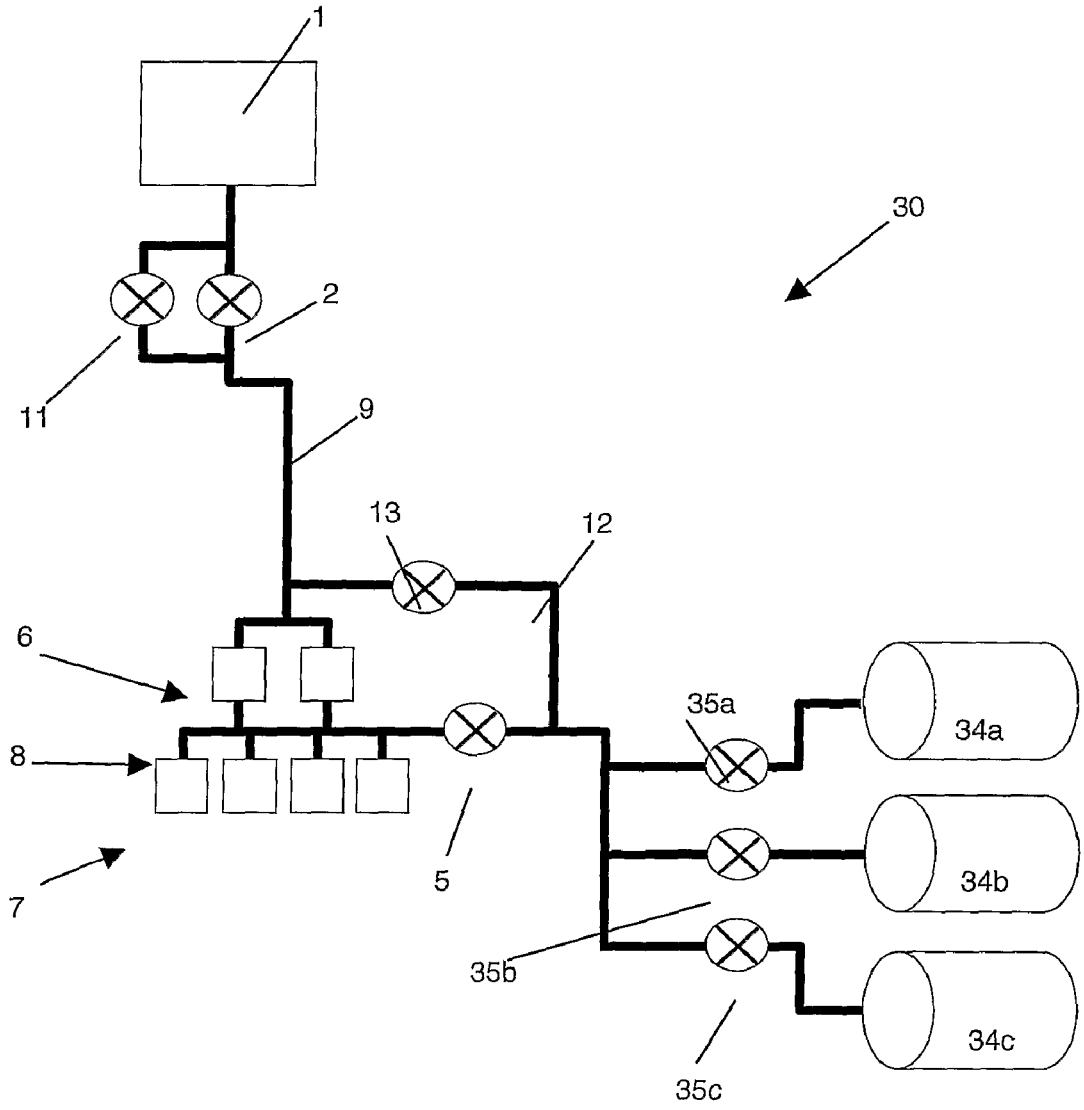
FIG. 8 illustrates a third embodiment of a system for evacuating an enclosure.

A third embodiment of an evacuation system 30 for evacuating an enclosure 1 is illustrated in FIG. 8. The system 30 is similar to the first embodiment illustrated in FIG. 2, with the exception that the auxiliary chamber 4 has been replaced by an arrangement of third isolation valves 35*a*, 35*b*, 35*c* and separate auxiliary chambers 34*a*, 34*b*, 34*c* which is similar to the arrangement of second isolation valves 25*a*, 25*b*, 25*c* and separate auxiliary chambers 24*a*, 24*b*, 24*c* of the second embodiment illustrated in FIG. 5.

Figure 9:
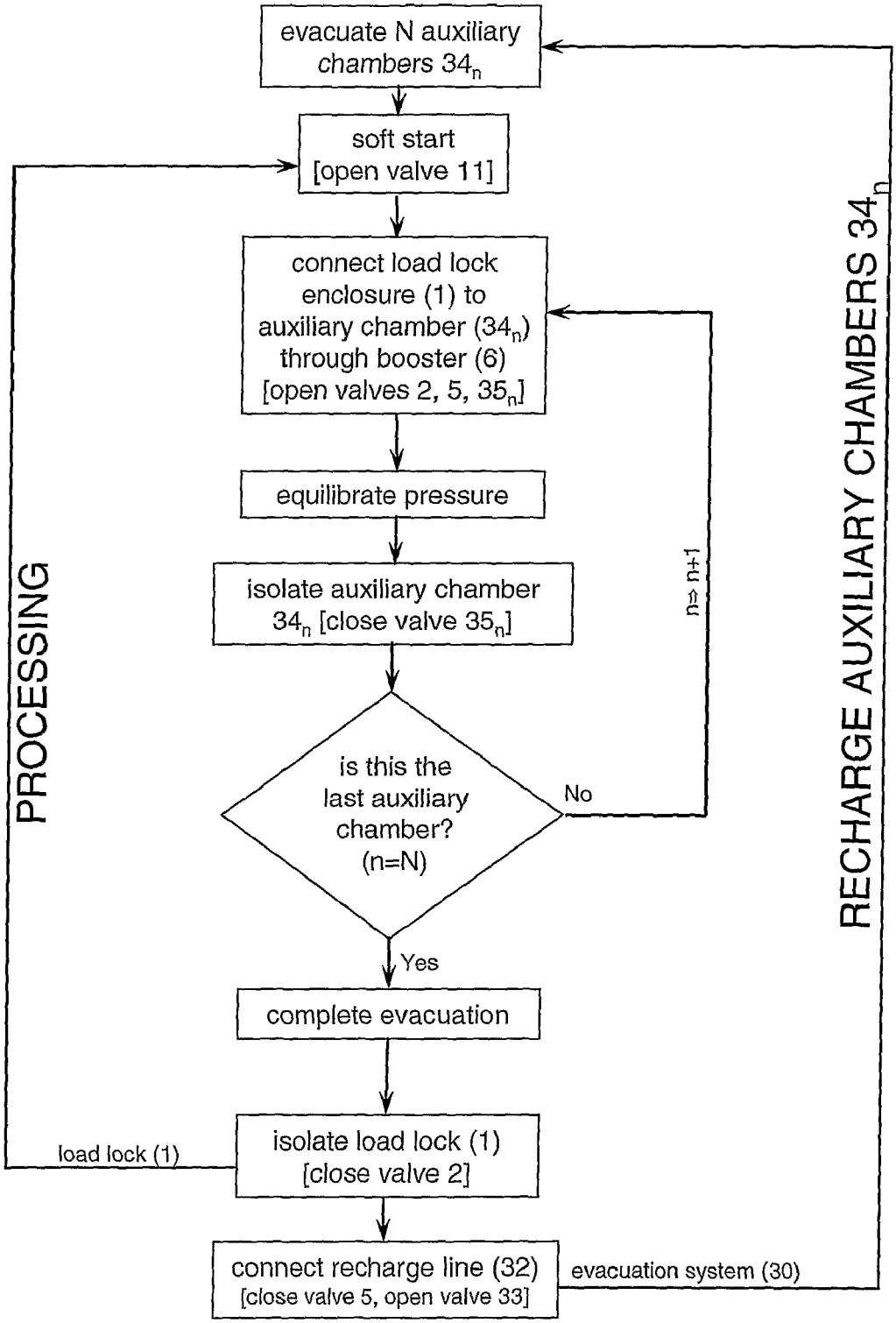
FIG. 9 is a flow chart representing an evacuation method to be carried out using the system of FIG. 8.

Operation of the evacuation system 30 is now described with reference to FIGS. 8 and 9. The enclosure 1 is initially isolated from the evacuation system 30 by closing the first isolation valve 2 and the additional valve 11. The auxiliary chambers are evacuated by the pumping arrangement 3 by closing the isolation valve 5 and opening recharge valve 13 so that the auxiliary chambers are connected to inlets of the booster pumps 6 via recharge conduit 12. Once the auxiliary chambers have been evacuated, recharge valve 33 is closed.

Again, in some circumstances it may be necessary to provide a "soft start" whereby the initial evacuation of the enclosure 1 is performed at a reduced rate. This may be necessary, for example, to prevent condensation occurring within the enclosure 1 due to the Wilson Cloud Effect. In these circumstances the first isolation valve 2 remains initially closed, and, as indicated by the dotted arrows and box in FIG. 9, the additional valve 11 is opened sufficiently to enable a relatively low gas flow to be drawn from the enclosure 1 by the pumping arrangement 3.

Following this initial evacuation, the pressure in the enclosure 1 is typically around 700 mbar. The first isolation valve 2 and the additional valve 11 are then fully opened, and the second isolation valve 5 and a first one of the third isolation valves 35*a* are opened to provide a flow path between the enclosure 1 and a first one of the auxiliary chambers 34*a*. Since this flow path goes through the booster pumps 6, a pressure difference is experienced across the pumping mechanisms of the booster pumps. This pressure difference causes the pumping mechanisms to be rotated, which, as discussed above with reference to the first embodiment, provides additional pumping capacity. The pressure difference across the pumping mechanisms of the booster pumps 6 reduces to zero and then, due to the additional pumping capacity associated with the momentum of the pumping mechanisms of the booster pumps 6, the pressure in the auxiliary chamber 34*a* may even rise above the equilibrium value expected under normal steady state conditions. At this point, isolation valve 35*a* is closed to isolate the auxiliary chamber 34*a* once again.

The next second isolation valve 35*b* is then opened such that the enclosure 1 is exposed to the second, evacuated auxiliary chamber 34*b*, again via the booster pumps 6. A second pressure equilibration phase takes place between the enclosure 1 and the second auxiliary chamber 34*b*. Once this is complete, isolation valve 35*b* is closed. This process is continued until each of the auxiliary chambers 34 has been used to further reduce the pressure in the enclosure 1.

The pumps 6, 7 then continue to operate to further evacuate the enclosure 1 to the desired pressure level (typically 0.1 mbar). Since gas from the enclosure 1 has been drawn through the booster pumps 6, retardation of the pumping mechanisms will, once again have been avoided and hence there is no need for the mechanism to be re-accelerated and thus delaying the final evacuation phase (phase C above). Once the enclosure 1 has reached the required pressure the enclosure 1 is isolated from the evacuation system 30 and the auxiliary chambers are recharged to return the evacuation system to its "ready" state.

Figure 10:
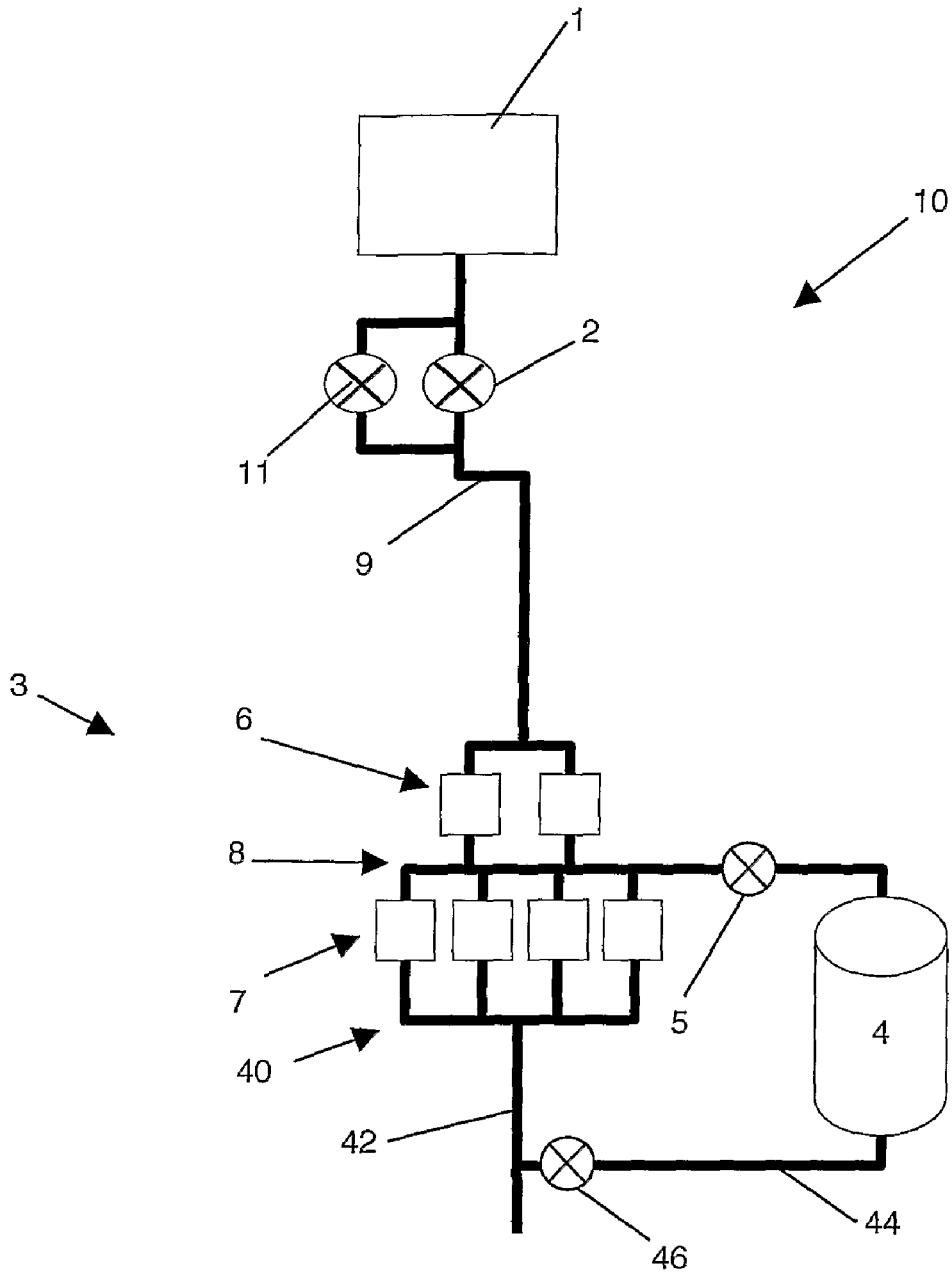
FIG. 10 illustrates a fourth embodiment of a system for evacuating an enclosure.

FIG. 10 illustrates a fourth embodiment of an evacuation system 10' for evacuating an enclosure 1 comprising a feature that can be incorporated into any of the aforementioned embodiments but is shown here in relation to apparatus similar to the first embodiment illustrated in FIG. 2. Outlets of each of the backing pumps 7 are connected together using a manifold arrangement 40 exhausting to a single exhaust line 42. The exhaust line 42 may be selectively connected directly to the auxiliary chamber 4 as shown in FIG. 10 via conduit 44 and isolation valve 46. In operation, subsequent to the equilibrating step whereby the pressure within the enclosure 1 is reduced and the pressure within the auxiliary chamber 4 is raised, the isolation valve 5 is closed. As described above, further evacuation of the enclosure 1 is undertaken by continued operation of the pumps 6, 7 until pressure within the enclosure reaches the desired level, typically 0.1 mbar.

The work done by any vacuum pump unit is proportional to the change in inlet pressure to outlet pressure. Consequently, where it is desirable to reduce the power requirements of the vacuum pump unit it is beneficial to reduce the outlet pressure of the vacuum pump unit below its typical value of atmospheric pressure. In this embodiment, after the isolation valve 5 has been closed following the equilibrating step, the isolation valve 46 may be opened. In so doing, the pressure within the exhaust line 42 is reduced below atmospheric pressure for a time due to the sub-atmospheric pressure within the auxiliary chamber. This leads to a lower power requirement of the backing pumps 7 until the pressure within auxiliary chamber 4 and thus at the outlets of the backing pumps 7, is raised to atmospheric pressure.

While the foregoing description and drawings represent the preferred embodiments of the present invention, it will be apparent to those skilled in the art that various changes and modifications may be made therein without departing from the true spirit and scope of the present invention.

We claim:

1. A system for evacuating an enclosure, the system comprising first pumping means having an inlet selectively connectable to an outlet from the enclosure, second pumping means, conduit means for connecting an exhaust of the first pumping means to an inlet of the second pumping means, and at least one auxiliary chamber selectively connectable to the conduit means via a second valve means in a manner where the second valve means selectively isolates the at least one auxiliary chamber from the first and second pumping means while the first and second pumping means are in fluid connection, such that, in a first state, gas can be drawn from said at least one auxiliary chamber by the second pumping means in isolation from the enclosure, and, in a second state, gas can be drawn from the enclosure to said at least one auxiliary chamber through the first pumping means.

2. The system according to claim 1 comprising first valve means for selectively connecting the inlet of the first pumping means to the enclosure.

3. The system according to claim 2 wherein, in the first state, the first valve means is in a closed position and the second valve means is in an open position, and in the second state both the first valve means and the second valve means are in open positions.

4. The system according to claim 1 wherein the first pumping means comprises at least one vacuum pump.

5. The system according to claim 4 wherein the at least one vacuum pump of the first pumping means comprises a plurality of vacuum pumps connected in parallel.

6. The system according to claim 4 wherein the at least one vacuum pump of the first pumping means comprises a booster pump.

7. The system according to claim 1 wherein the second pumping means comprises at least one vacuum pump.

8. The system according to claim 7 wherein at least one vacuum pump of the second pumping means comprises a plurality of vacuum pumps connected in parallel to the conduit means.

9. The system according to claim 7 wherein the at least one vacuum pump of the second pumping means comprises a backing pump.

10. The system according to claim 1 comprising second conduit means for selectively connecting the inlet of the first pumping means to said at least one auxiliary chamber.

11. The system according to claim 1 comprising third conduit means for selectively connecting the outlet of the second pumping means to said at least one auxiliary chamber.

12. The system according to claim 1 wherein said at least one auxiliary chamber comprises a single auxiliary chamber selectively connected to said conduit means.

13. The system according to claim 1 wherein said at least one auxiliary chamber comprises a plurality of auxiliary chambers each being selectively connectable to said conduit means.

14. The system according to claim 13 comprising third valve means for selectively connecting a selected one of the auxiliary chambers to the conduit means in isolation from at least one of the plurality of auxiliary chambers.

* * * * *